US010464779B1

(12) United States Patent
Kammer et al.

(10) Patent No.: US 10,464,779 B1
(45) Date of Patent: Nov. 5, 2019

(54) CABLE STORAGE SYSTEM

(71) Applicant: Cable Wrangler, LLC, Prescott, AZ (US)

(72) Inventors: Jason A. Kammer, Avondale, AZ (US); Craig S. Ridenhour, Prescott, AZ (US)

(73) Assignee: CABLE WRANGLER, LLC, Prescott, AZ (US)

( * ) Notice: Subject to any disclaimer, the term of this patent is extended or adjusted under 35 U.S.C. 154(b) by 0 days.

(21) Appl. No.: 16/279,363

(22) Filed: Feb. 19, 2019

Related U.S. Application Data

(60) Provisional application No. 62/634,839, filed on Feb. 24, 2018.

(51) Int. Cl.
*B65H 75/26* (2006.01)
*A47B 81/00* (2006.01)

(52) U.S. Cl.
CPC ..... *B65H 75/26* (2013.01); *A47B 81/00* (2013.01); *B65H 2701/34* (2013.01)

(58) Field of Classification Search
CPC .... B65H 75/26; B65H 2701/34; B65H 85/04; A47B 81/00
USPC ..... 248/68.1, 69, 74.3, 58, 62, 89; 206/702, 206/495; 174/68.1, 68.3, 72 A, 135
See application file for complete search history.

(56) References Cited

U.S. PATENT DOCUMENTS 254,333 A * 2/1882 Kane ..... F16L 3/2235 248/68.1
792,594 A * 6/1905 Hiss ..... F16L 3/06 248/69
1,246,325 A * 11/1917 Rohmer ..... F16L 3/1233 248/74.3
1,262,763 A * 4/1918 Farley ..... F16L 3/14 248/62
1,365,616 A * 1/1921 Karitzky ..... F16L 3/06 248/69
1,365,619 A * 1/1921 Pleister ..... F16L 3/06 248/69
1,365,620 A * 1/1921 Karitzky ..... F16L 3/06 248/69
1,365,621 A * 1/1921 Pleister ..... F16L 3/06 248/69
1,365,628 A * 1/1921 Karitzky ..... F16L 3/06 248/69
1,365,632 A * 1/1921 Pleister ..... F16L 3/06 248/69
1,381,232 A * 6/1921 Pleister ..... F16L 3/06 248/69

(Continued)

*Primary Examiner* — Jonathan Liu
*Assistant Examiner* — Devin K Barnett
(74) *Attorney, Agent, or Firm* — Robert Crownover

(57) ABSTRACT

A cable storage system and methods can include: providing a bungee ball having a ball and an elastic cord, the elastic cord forming a loop and the elastic cord coupled to the ball at an attachment point, the loop configured to be fastened around a cable and secured around the ball; and forming a storage rack having a container affixed to a handle, the container having a side opening and a bottom opening, the side opening extending from a top area of the container to the bottom opening, the container configured to fit the ball therein, the side opening configured to allow the loop to be threaded therethrough and to extend out of the bottom opening.

11 Claims, 6 Drawing Sheets

(56) References Cited

U.S. PATENT DOCUMENTS 1,381,234 A * 6/1921 Pleister ..... F16L 3/06 248/69
1,381,238 A * 6/1921 Pleister ..... F16L 3/06 248/69
1,381,239 A * 6/1921 Pleister ..... F16L 3/06 248/69
1,387,489 A * 8/1921 Hiss ..... F16L 3/06 248/69
1,450,640 A * 4/1923 Norman ..... F16L 3/14 248/59
1,602,503 A * 10/1926 Pleister ..... F16L 3/23 248/69
1,623,792 A * 4/1927 Karitzky ..... F16L 3/06 248/69
1,763,770 A * 6/1930 Fish ..... F16L 3/06 248/69
1,799,245 A * 4/1931 Pleister ..... F16L 3/06 248/69
1,804,807 A * 5/1931 Pleister ..... H02G 7/05 248/69
2,338,658 A * 1/1944 Morehouse ..... F16L 3/1233 248/74.3
3,284,038 A * 11/1966 Udry ..... F16L 3/233 248/74.3
3,432,129 A * 3/1969 Santucci ..... F16L 3/237 248/69
4,824,057 A * 4/1989 Suprono ..... F16L 3/133 24/129 B
4,826,193 A * 5/1989 Davis ..... A61G 5/10 248/499
4,929,116 A * 5/1990 Mahl ..... A47B 43/02 403/263
4,993,961 A * 2/1991 Hisatomi ..... F16L 3/223 248/68.1
5,109,321 A * 4/1992 Maglica ..... B62J 6/00 248/288.31
5,449,067 A * 9/1995 Cannon ..... H02G 11/02 174/135
5,785,289 A * 7/1998 Shieh ..... B62H 5/003 248/230.1
5,957,416 A * 9/1999 Sellati ..... H02G 3/26 248/58
6,142,892 A * 11/2000 Dennis ..... A63B 63/004 248/74.3
6,494,411 B1 * 12/2002 Bjorklund ..... F16L 3/24 248/228.6
6,802,480 B1 * 10/2004 Martello ..... F16L 3/237 24/373
6,886,796 B1 * 5/2005 Elander ..... A47F 5/0006 211/70.6
7,025,309 B2 * 4/2006 Goodwin ..... F16L 3/1233 248/62
7,131,792 B2 * 11/2006 Doverspike ..... E03C 1/021 405/184.4
7,383,959 B1 * 6/2008 Rudd ..... A47F 7/00 211/13.1
7,534,965 B1 * 5/2009 Thompson ..... H02G 3/22 16/2.1
7,677,506 B1 * 3/2010 Hammer ..... B60D 1/62 248/58
7,712,709 B2 * 5/2010 Winchester ..... F16L 3/223 211/70.1
8,133,039 B2 * 3/2012 Anderson ..... A61H 9/0078 137/355.16
8,262,035 B2 * 9/2012 Bleus ..... F16L 3/1025 248/230.7
8,342,459 B2 * 1/2013 Garrison ..... H01R 12/63 248/316.7
8,413,398 B1 * 4/2013 Allred ..... F16G 11/06 248/181.1
8,459,598 B2 * 6/2013 Gardner ..... F16L 3/133 248/58
8,919,707 B2 * 12/2014 Lee ..... H02G 3/30 248/56
8,985,533 B2 * 3/2015 Edmond ..... F16L 3/227 248/68.1
9,345,346 B1 * 5/2016 O'Flaherty ..... B65H 75/36
10,012,330 B1 * 7/2018 Thomas ..... F16L 3/16
D853,336 S * 7/2019 Barram ..... D13/155
2002/0043592 A1 * 4/2002 Frazier ..... B65H 75/366 248/68.1
2004/0169106 A1 * 9/2004 Huang ..... G06F 3/03543 242/385.3
2004/0173545 A1 * 9/2004 Canty ..... G02B 6/4459 211/26
2005/0045776 A1 * 3/2005 Yudis ..... F16L 35/00 248/89
2005/0056736 A1 * 3/2005 Thompson ..... F16L 3/133 248/58
2006/0086530 A1 * 4/2006 Knabel ..... H01R 25/16 174/135
2006/0121774 A1 * 6/2006 Ebert ..... H01R 13/5812 439/445
2007/0200034 A1 * 8/2007 Urzua ..... F16L 3/223 248/68.1
2010/0122834 A1 * 5/2010 Chang ..... B65H 75/36 174/135
2010/0147580 A1 * 6/2010 Koesterich ..... B65H 75/446 174/520
2010/0264279 A1 * 10/2010 Allen ..... B65H 75/366 248/68.1
2010/0327099 A1 * 12/2010 Kuo ..... B65H 75/4452 242/378
2011/0089294 A1 * 4/2011 Buytaert ..... F16L 3/133 248/58
2011/0147542 A1 * 6/2011 Hoek ..... F16L 3/223 248/68.1
2011/0168597 A1 * 7/2011 Titros ..... B65D 73/0064 206/495
2012/0037766 A1 * 2/2012 Buras, Jr. ..... F16L 3/137 248/68.1
2013/0032654 A1 * 2/2013 Tracey ..... B65H 75/4471 242/390.8
2013/0220670 A1 * 8/2013 Tomita ..... H01B 17/14 174/135
2013/0294018 A1 * 11/2013 Mochizuki ..... F16M 11/10 361/679.01
2014/0014788 A1 * 1/2014 Chen ..... H02G 3/0481 248/74.3
2014/0096344 A1 * 4/2014 Creato ..... B65D 85/04 24/16 PB
2014/0117171 A1 * 5/2014 Mori ..... G10D 13/00 248/69
2014/0291456 A1 * 10/2014 Rego ..... F16L 3/1211 248/69
2014/0299704 A1 * 10/2014 Hollowed ..... B65H 75/486 242/371
2015/0083983 A1 * 3/2015 Yi ..... H02G 1/06 254/134.3 R
2015/0211659 A1 * 7/2015 Even ..... H02G 3/32 248/69
2015/0285406 A1 * 10/2015 Kern ..... H02G 3/0443 248/68.1
2016/0204560 A1 * 7/2016 Rodriguez ..... B65H 75/28 242/587
2016/0355374 A1 * 12/2016 Sinnett ..... F16L 3/1075
2017/0204995 A1 * 7/2017 Leng ..... H02G 3/32
2017/0242460 A1 * 8/2017 Mitsuishi ..... H02G 3/30
2017/0341901 A1 * 11/2017 Makrinos ..... B65H 75/36
2019/0071277 A1 * 3/2019 Park ..... B65H 75/20
2019/0074673 A1 * 3/2019 Koch ..... F16L 3/13

* cited by examiner

CABLE STORAGE SYSTEM

CROSS-REFERENCE TO RELATED APPLICATION(S)

This claims priority benefit to all common subject matter of U.S. Provisional Patent Application No. 62/634,839 filed Feb. 24, 2018. The content of this application, in its entirety, is incorporated herein by reference.

TECHNICAL FIELD

This disclosure relates to storage, more particularly to cable storage solutions implementing bungee balls.

BACKGROUND

Amateur and professional musicians, as well as practitioners of other performance arts, often rely upon electrical equipment including loudspeakers, microphones, amplifiers, and synthesizers. Almost invariably, these specific pieces of equipment are connected with both power extension cables and audio cables.

These cables are often of similar diameter but can vary in length from under 1 meter to over 100 meters. Illustratively, way of example, a typical five-piece rock band could utilize several dozens of these cables.

Many musicians, as well as those related to the production of such performances, are required to periodically, disconnect, store, and transport their audio equipment to a different venue. This requirement can arise daily in some cases.

Once the musician is at a new venue, the procedure will be reversed. This consistent connecting and disconnecting, setting-up and tearing-down, can often leave the cables in a disorganized and tangled chaos.

Various methods of organizing and transporting cables are employed by their users. For example, some users will coil the cables neatly and tie them with a strip of hook-and-loop fastener, and then insert the cable into a suitcase. While this process can produce a neat set of cables, this process is time consuming and requires patience and dexterity which may not be available.

Others may coil them similarly, and then insert them into a milk crate, or a cardboard box. Still others will merely leave them attached to equipment and transport them as-is.

These methods of storage and transportation, however, suffer a number of drawbacks. Primarily, it is difficult for the user to identify and select a specific cable, when it is intermingled with other similar items. Similarly, the user may find it difficult to retrieve a specific cable, as the cables often become entangled with other cables.

Further, the milk crates and cardboard boxes, or other means of conveyance, which the user utilizes, are often cumbersome or unwieldy, and certainly not well suited to the task. This is particularly apparent in environments which require the user to transport the cables a long distance on foot, as would be the case in casinos, churches, or nightclubs, where the parking of a user's vehicle may be of considerable distance from the stage upon which the cables are required.

As such, a need exists for devices and apparatuses capable of neatly, easily, and intuitively, storing, organizing, and transporting cables. Yet further, a need exists for a convenient means of isolating specific cables without the cable becoming entangled with other cables in close proximity.

Solutions have been long sought but prior developments have not taught or suggested any complete solutions, and solutions to these problems have long eluded those skilled in the art. Thus, there remains a considerable need for devices and methods of storing cables, isolating cables, organizing cables, and transporting cables.

SUMMARY

A cable storage system and methods, providing significantly improved storage, isolation, organization, and transportation of cables, are disclosed. The cable storage system and methods can include: providing a bungee ball having a ball and an elastic cord, the elastic cord forming a loop and the elastic cord coupled to the ball at an attachment point, the loop configured to be fastened around a cable and secured around the ball; and forming a storage rack having a container affixed to a handle, the container having a side opening and a bottom opening, the side opening extending from a top area of the container to the bottom opening, the container configured to fit the ball therein, the side opening configured to allow the loop to be threaded therethrough and to extend out of the bottom opening.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE DRAWINGS

The cable storage system is illustrated in the figures of the accompanying drawings which are meant to be exemplary and not limiting, in which like reference numerals are intended to refer to like components, and in which.

DETAILED DESCRIPTION

Figure 1:
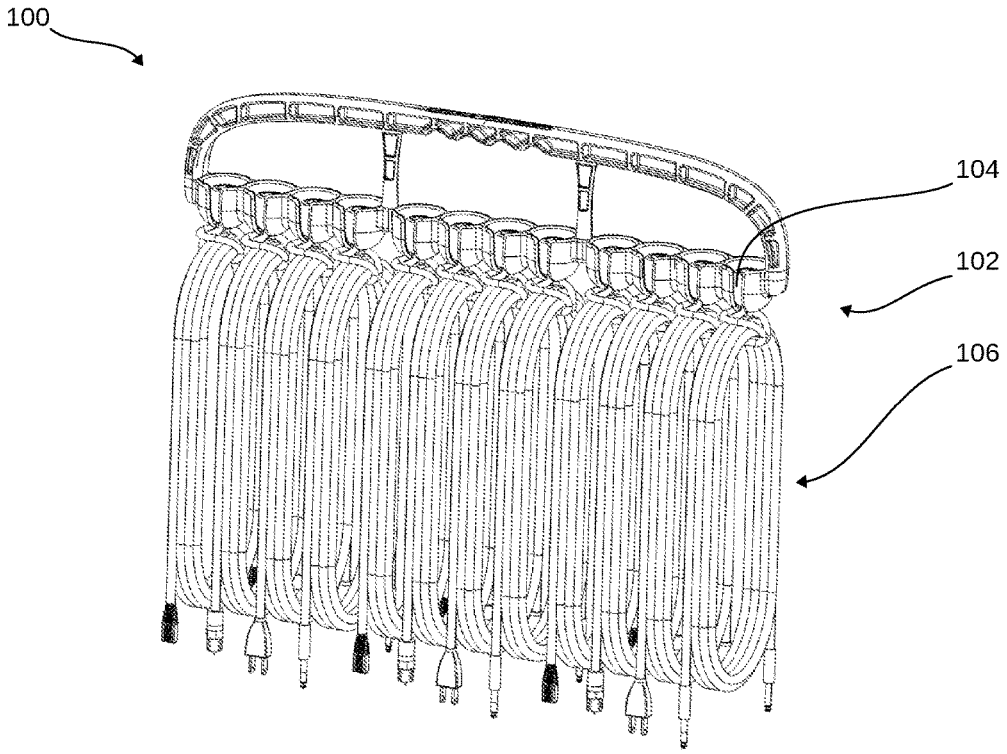
FIG. 1 is an isometric view of the cable storage system in a first embodiment.

In the following description, reference is made to the accompanying drawings that form a part hereof, and in which are shown by way of illustration, embodiments in which the cable storage system may be practiced. It is to be understood that other embodiments may be utilized and structural changes may be made without departing from the scope of the cable storage system.

When features, aspects, or embodiments of the cable storage system are described in terms of steps of a process, an operation, a control flow, or a flow chart, it is to be understood that the steps can be combined, performed in a different order, deleted, or include additional steps without departing from the cable storage system as described herein.

The cable storage system is described in sufficient detail to enable those skilled in the art to make and use the cable storage system and provide numerous specific details to give a thorough understanding of the cable storage system; however, it will be apparent that the cable storage system may be practiced without these specific details.

In order to avoid obscuring the cable storage system, some well-known system configurations and descriptions are not disclosed in detail. Likewise, the drawings showing embodiments of the system are semi-diagrammatic and not to scale and, particularly, some of the dimensions are for the clarity of presentation and are shown greatly exaggerated in the drawing FIGs.

As used herein, the term system is defined as a device or method depending on the context in which it is used. For expository purposes, the term "vertical" as used herein is defined as a line parallel to the interior vertical surface of the containers, regardless of its orientation. The term "horizontal" refers to a direction perpendicular to the vertical as just defined. Terms, such as "above", "below", "bottom", "top", "side", "higher", "lower", "upper", "over", and "under", are defined with respect to the horizontal plane.

Referring now to FIG. 1, therein is shown an isometric view of the cable storage system 100 in a first embodiment. The cable storage system 100 is shown having a storage rack 102 containing bungee balls 104.

The bungee balls 104 can be looped and cinched around cables 106. The bungee balls 104 can be individually held within the containers 306 of FIG. 3 allowing the cables 106 to hang neatly down from the bungee balls 104 and containers 306.

The cables 106 are shown to be electric cables, however it should be understood that the cables 106 could be a multitude of other cables such as ropes or elastic cables, and in some embodiments could include pneumatic or hydraulic cables. It has been discovered that the only limiting factor to what type of cable can be stored with the cable storage system 100 is the ability of the cables 106 to be secured and held with the bungee balls 104.

Figure 2:
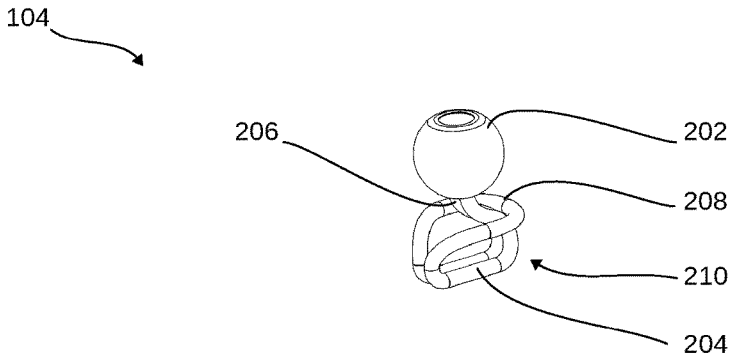
FIG. 2 is an isometric view of the bungee ball of FIG. 1.

Referring now to FIG. 2, therein is shown an isometric view of the bungee ball 104 of FIG. 1. The bungee ball 104 is depicted including a ball 202 and an elastic cord 204.

The ball 202 can be an enlarged solid portion of the bungee ball 104 and can have a width larger than a width of an attachment point 206 of the elastic cord 204 to the ball 202. The width of the attachment point 206 can be two cross-sectional widths of the elastic cord 204, as two ends of the elastic cord 204 are affixed to the ball 202 and form the attachment point 206.

The elastic cord 204 can be an elastic cable surrounded by a fabric sheath. Alternatively, the elastic cord 204 can be a simple rubber element or tube. In some contemplated embodiments, the elastic cord attachment point 206 can be covered with an additional sheath covering the elastic cord attachment point 206 near the ball 202.

Figure 3:
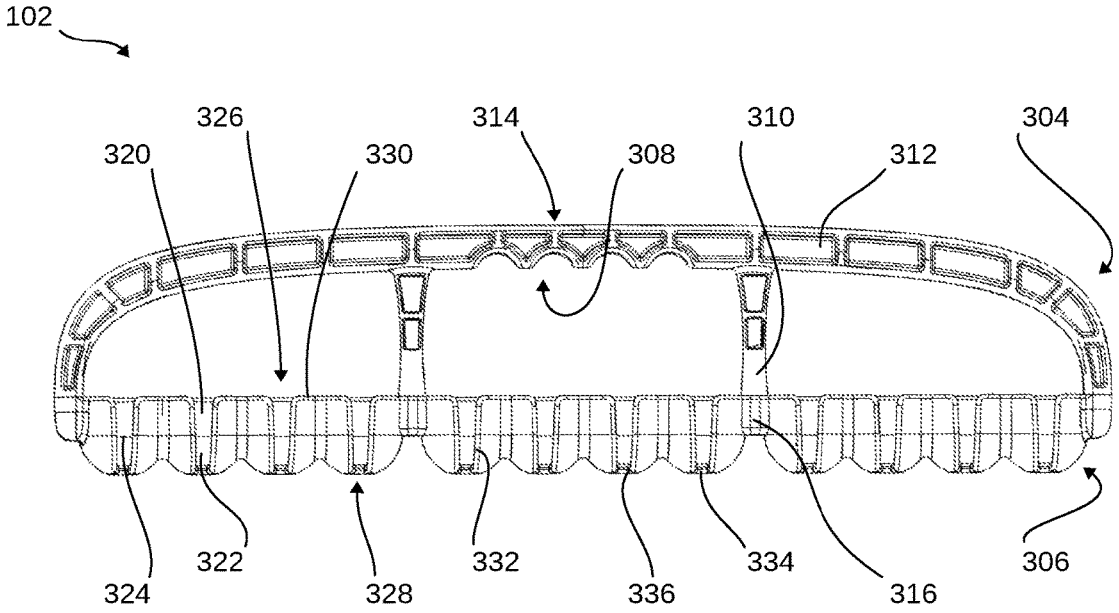
FIG. 3 is a front side view of the storage rack of FIG. 1.

The elastic cord attachment point 206 is smaller than a width of the bottom opening 328 of FIG. 3 while having a width larger than the distance between the friction extension 336 of FIG. 3. The elastic cord attachment point 206 can also be configured to be wide enough to impinge on the side opening 326 of FIG. 3 for providing friction between the elastic cord attachment point 206 and the side opening 326.

The ball 202 is shown and depicted as spherical, however it is contemplated that other shapes of the ball 202 could be used without departing from the disclosure of the cable storage system 100. The elastic cord 204 is shown folded over on itself to create a loop 208. The loop 208 being attached to the ball 202 at the attachment point 206.

As will be appreciated by those skilled in the art, the two lengths of the elastic cord 204 forming the loop 208 can be threaded through a center of one of the cables 106 of FIG. 1 and then folded back over and around the cable 106 and secured around the ball 202 to tightly restrain the coiled cable within a double loop 210.

The coiled cable can be held securely by the double loop 210 of the elastic cord 204 while the ball 202 can then be placed in the storage rack 102 of FIG. 1 for storage, transportation, or display. For descriptive clarity, the coiled cables of FIG. 1 are shown with the loop 208 fastened around the cable 106 and the loop 208 secured around the ball 202.

Referring now to FIG. 3, therein is shown a front side view of the storage rack 102 of FIG. 1. The storage rack 102 is shown having a handle 304 in direct physical contact with containers 306.

The handle 304 can include finger grooves 308 for providing an intuitive and secure hand placement for most hand sizes. On either side of the finger grooves 308, the handle 304 is shown having handle supports 310.

The handle supports 310 can extend from the handle 304 to the containers 306 and form another attachment point between the handle 304 and the containers 306. It is contemplated that the handle supports 310 could be formed integrally with the handle 304 and later attached to the containers 306.

Alternatively, it is contemplated that the handle supports 310 could be affixed to both the handle 304 as well as the containers 306 after formation of the handle 304. The handle 304, along with the handle supports 310, are shown skeletonized with material removal recesses 312 formed therein.

It has been discovered that the material removal recesses 312 can reduce the overall weight of the cable storage system 100 of FIG. 1, which allows easier and more nuanced use of the cable storage system 100 while simultaneously retaining a highly rigid structure. The handle 304 can further include texturing 314. The texturing 314 can be a patterned texture, a company logo, or a combination thereof.

The handle 304 and the handle supports 310 can be coupled to the containers 306 at mounting platforms 316. The handle 304 can be screwed down onto the mounting platforms 316 with screws extending through the mounting platforms 316 and into female threaded recesses of the handle supports 310 and ends of the handle 304. The mounting platforms 316 can be formed integral with the containers 306 and can include a female threaded recess for screwing the handle 304 down onto the mounting platforms 316.

The mounting platforms 316 can be edge mounting platforms on either side of the cable storage system 100. The mounting platforms 316 can also be internal mounting platforms formed between the containers 306.

The mounting platforms 316 can be formed together with and integral to the containers 306 so that the containers 306 should be understood to include the mounting platforms 316. The containers 306 themselves are shown to be evenly spaced with the mounting platforms 316. The mounting platforms 316 can increase the distance between some of the containers 306 when the containers 306 are on either side of the mounting platforms 316.

Each of the containers 306 can include an interior vertical surface 320 and an interior bottom surface 322. The containers 306 can transition from the interior vertical surface 320 to the interior bottom surface 322 at a bottom transition 324.

The bottom transition 324 can extend around the interior of the containers 306 and can separate the interior vertical surface 320 from the interior bottom surface 322. The bottom transition 324 can be the line within the containers 306 when the interior surface changes from being straight and vertical as part of the interior vertical surface 320 to a curved inward-sloping bottom surface of the interior bottom surface 322.

As is shown, the interior bottom surface 322 can approximate a hemisphere although other shapes of the interior bottom surface 322 are contemplated. For example, a flat interior bottom surface 322 is contemplated. Further an interior bottom surface 322 with a steeper or shallower curve from a hemisphere is contemplated. Yet further, an embodiment of the interior bottom surface 322 could include straight angled surfaces.

The interior vertical surface 320 is formed to fit the bungee ball 104 of FIG. 1 so that the ball 202 of FIG. 2 can slide down the interior vertical surface 320 into the interior bottom surface 322. The elastic cord 204 of FIG. 2 can be moved through a side opening 326 and down through a bottom opening 328.

The side opening 326 can taper from a top area to near a bottom area. Specifically, as the side opening 326 extends toward the bottom opening 328, the side opening 326 gets narrower. The side opening 326 can begin with a larger width which can allow the elastic cord 204 to move freely therein and without friction induced by the rubbing between the side opening 326 and the elastic cord 204.

As the side opening 326 tapers, the width of the side opening 326 becomes small enough to create friction with the elastic cord 204 of the bungee ball 104 when it is pulled through the side opening 326. It is alternatively contemplated that the side opening 326 can have a constant width from the top area down to near the bottom area. The containers 306 can include an upper lip 330.

The upper lip 330 can be a rounded lip around the edge of the interior vertical surface 320. The side opening 326, which transitions from the upper lip 330 to the bottom opening 328 can also include an opening lip 332. The opening lip 332, similar to the upper lip 330, can be rounded. The upper lip 330 and the opening lip 332 can provide smooth operation of the cable storage system 100 by enabling a user to load the containers 306 quickly and without the additional wear on the elastic cord 204 that could accompany a non-rounded corner.

The rounded edge of the upper lip 330 and the opening lip 332 are depicted surrounding the bottom opening 328 as a bottom lip 334. The containers 306 can further include friction extensions 336.

The friction extensions 336 can be formed near the intersection of the opening lip 332 and the bottom lip 334. The friction extensions 336 can extend out into the side opening 326, narrowing the side opening 326 nearest to the bottom opening 328.

The friction extension 336 can increase the friction on the elastic cord 204 of the bungee ball 104 when the elastic cord 204 is slid through the side opening 326 and into the bottom opening 328. It is contemplated that the friction extension 336 can increase the friction to a point where a click can be produced when the elastic cord 204 of the bungee ball 104 is slid through the friction extension 336 and into the bottom opening 328.

It is contemplated that a user could grip the loop 208 near the attachment point 206 of FIG. 2, orient the ball 202 over one of the containers 306 and slide the ball 202 down into the interior vertical surface 320 until contact is made with the interior bottom surface 322. Once the ball 202 contacts the interior bottom surface 322 the user can rotate the attachment point 206 of the bungee ball 104 down through the friction extension 336 to extend through the bottom opening 328.

Figure 4:
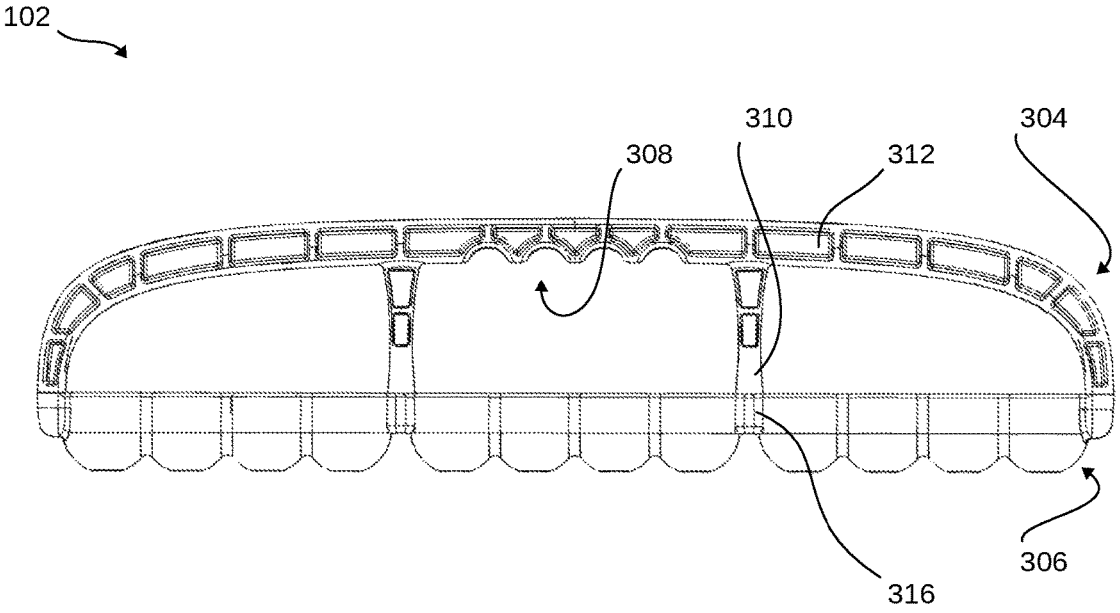
FIG. 4 is a back side view of the storage rack of FIG. 1.

Referring now to FIG. 4, therein is shown a back side view of the storage rack 102 of FIG. 1. The storage rack 102 depicts the back side of the handle 304 and the containers 306.

The handle 304 is shown having the material removal recesses 312 along with the handle supports 310 extending from near the finger grooves 308 to the mounting platforms 316 between the containers 306. The outer surface of the containers 306 can be seen to mirror the interior vertical surface 320 of FIG. 3 as well as the interior bottom surface 322 of FIG. 3.

Figure 5:
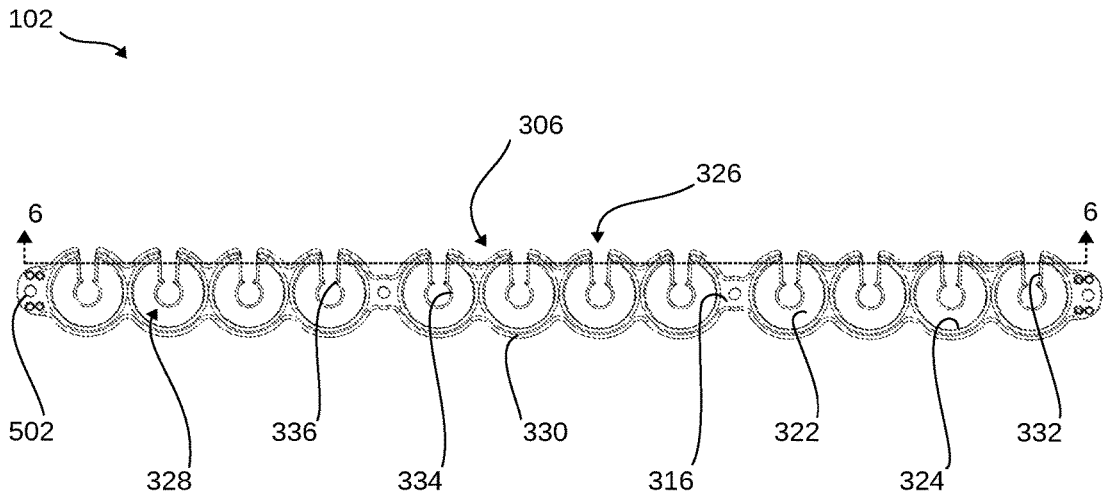
FIG. 5 is a top side view of the storage rack of FIG. 1 without the handle of FIG. 3.

Referring now to FIG. 5, therein is shown a top side view of the storage rack 102 of FIG. 1 without the handle 304 of FIG. 3. The containers 306 are shown having the interior bottom surface 322 extending from the bottom transition 324 to the bottom lip 334.

The bottom lip 334 is depicted surrounding the bottom opening 328. The bottom lip 334 of the bottom opening 328 can be open at the side opening 326.

Between the bottom opening 328 and the side opening 326 the friction extension 336 can be formed. The friction extension 336 are shown to be formed with extended portions of the bottom lip 334 and the opening lip 332.

The mounting platforms 316 are shown at either end of the storage rack 102 as well as between the containers 306. Each of the mounting platforms 316 can include a through hole 502 for allowing screws to be inserted therein and to screw into female threaded portions of the handle 304 and the handle supports 310 of FIG. 3.

Figure 6:
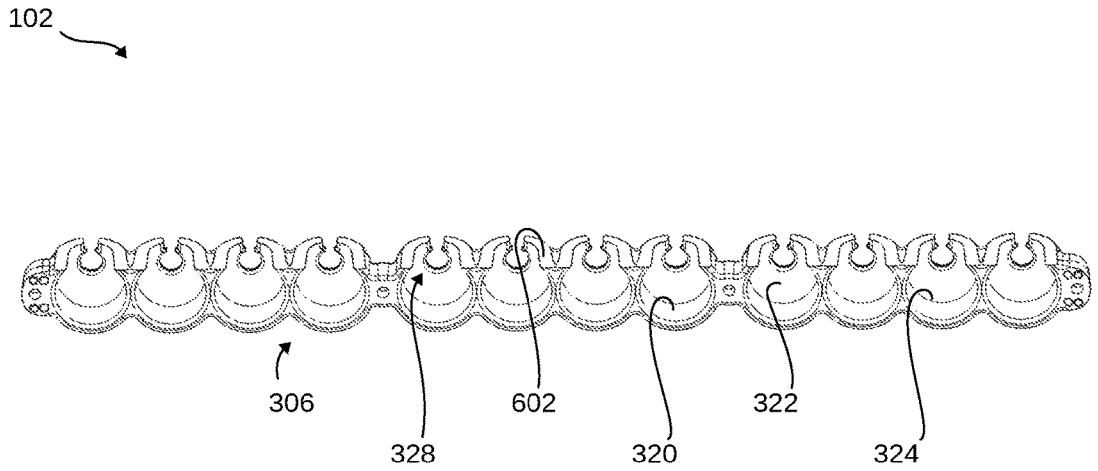
FIG. 6 is a cross-sectional isometric view of the storage rack along the line 6-6 of FIG. 5.

Referring now to FIG. 6, therein is shown a cross-sectional isometric view of the storage rack 102 along the line 6-6 of FIG. 5. An interior structure 602 of the containers 306 is shown roughly mirroring the interior vertical surface 320 and the interior bottom surface 322.

The interior structure 602 can be thickest near the interior vertical surface 320 and can taper after the bottom transition 324. The interior structure 602 can taper from a larger thickness near the bottom transition 324 to a smaller thickness near the bottom opening 328.

Figure 7:
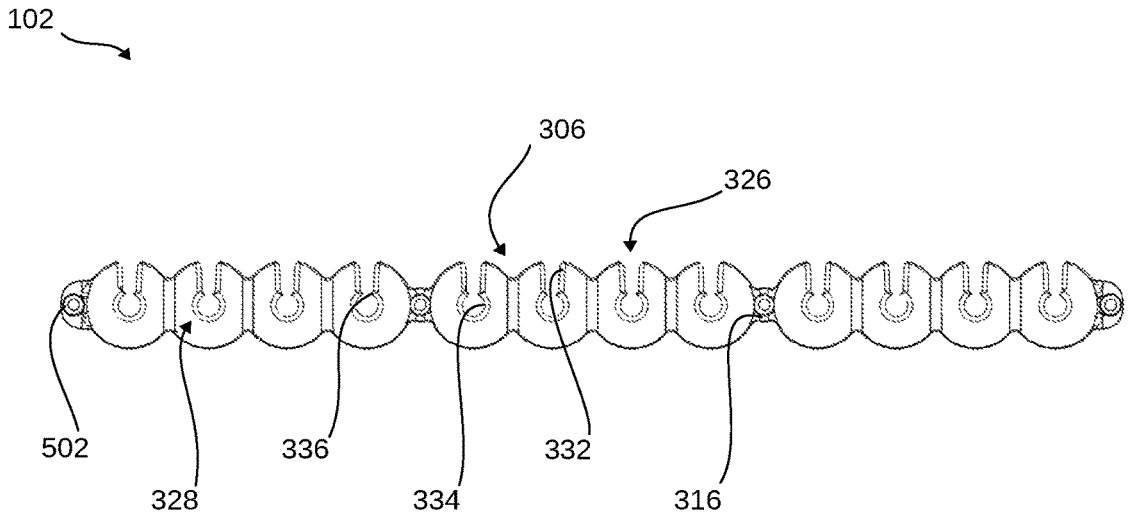
FIG. 7 is a bottom side view of the storage rack of FIG. 1.

Referring now to FIG. 7, therein is shown a bottom side view of the storage rack 102 of FIG. 1. The containers 306 are shown with the bottom lip 334 surrounding the bottom opening 328. The bottom lip 334 of the bottom opening 328 can be open at the side opening 326.

Between the bottom opening 328 and the side opening 326 the friction extension 336 is shown. The friction extension 336 are shown to be formed with extended portions of the bottom lip 334 and the opening lip 332.

The mounting platforms 316 are shown at either end of the storage rack 102 as well as between the containers 306. Each of the mounting platforms 316 can include the through hole 502 for allowing screws to be inserted therein and to screw into female threaded portions of the handle 304 of FIG. 3 and the handle supports 310 of FIG. 3.

Figure 8:
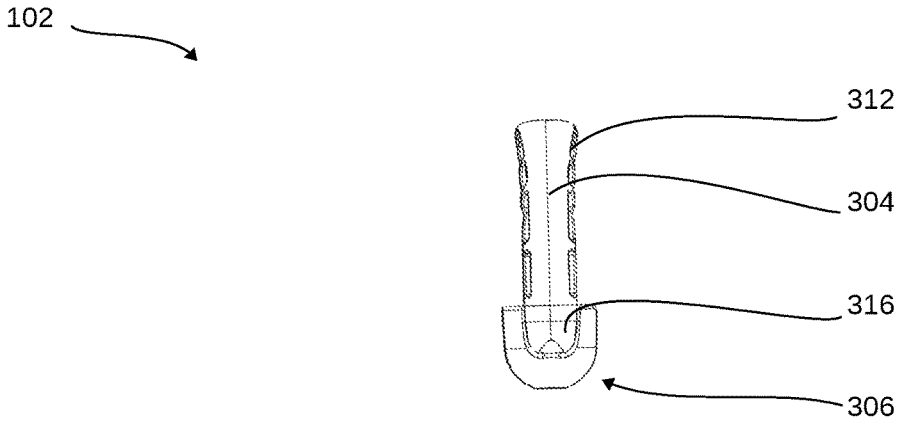
FIG. 8 is a right side view of the storage rack of FIG. 1.

Referring now to FIG. 8, therein is shown a right side view of the storage rack 102 of FIG. 1. The storage rack 102 is shown having the handle 304 coupled to the mounting platforms 316 of the containers 306.

The handle 304 can be depicted as flaring outward as the handle 304 extends away from the containers 306. The handle 304 is shown having the material removal recesses 312 for providing a structurally rigid handle 304 without excessive weight.

Figure 9:
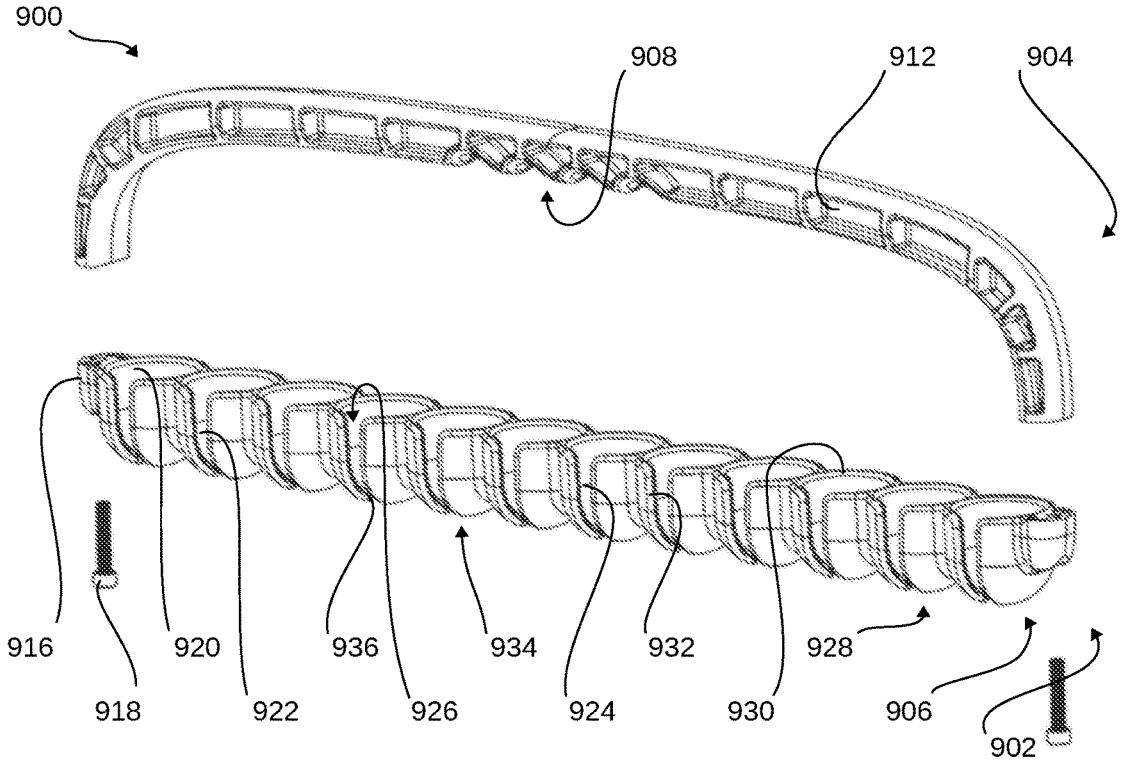
FIG. 9 is an exploded isometric view of the cable storage system in a second embodiment.

Referring now to FIG. 9, therein is shown an exploded isometric view of the cable storage system 900 in a second embodiment. A storage rack 902 of the cable storage system 900 is shown having a handle 904 in alignment with containers 906 for attachment thereto.

The handle 904 can include a handle grip 908 for providing an intuitive and secure hand placement for most hand sizes. In some embodiments, it has been discovered that the need for handle supports can be omitted from embodiments when the intended weight of cables 106 of FIG. 1 to be hung from the containers 906 will not cause deformation of the handle 904. The handle 904 is shown skeletonized with material removal recesses 912 formed therein.

It has been discovered that the material removal recesses 912 can reduce the overall weight of the cable storage system 900, which allows easier and more nuanced use of the cable storage system 900 while simultaneously retaining a highly rigid structure. The handle 904 is shown smooth without texturing, which can contribute to snag free use.

The handle 904 can be coupled to the containers 906 at mounting platforms 916. The mounting platforms 916 can be formed integral with the containers 906 and can include a through hole. The handle 904 can be screwed down onto the mounting platforms 916 with screws 918 extending through the mounting platforms 916 and into female threaded recesses on the ends of the handle 904.

The mounting platforms 916 can be edge mounting platforms on either side of the cable storage system 900. The mounting platforms 916 can be formed together with and integral to the containers 906 so that the containers 906 should be understood to include the mounting platforms 916. The containers 906 themselves are shown to be evenly spaced between the mounting platforms 916.

Each of the containers 906 can include an interior vertical surface 920 and an interior bottom surface 922. The containers 906 can transition from the interior vertical surface 920 to the interior bottom surface 922 at a bottom transition 924.

The bottom transition 924 can extend around the interior of the containers 906 and can separate the interior vertical surface 920 from the interior bottom surface 922. The bottom transition 924 can be the line within the containers 906 when the interior surface changes from being straight and vertical as part of the interior vertical surface 920 to a curved inward-sloping bottom surface of the interior bottom surface 922.

As is shown, the interior bottom surface 922 can approximate a hemisphere although other interior bottom surfaces 922 are contemplated. For example, a flat interior bottom surface 922 is contemplated. Further an interior bottom surface 922 with a steeper or shallower curve from a hemisphere is contemplated. Yet further, an embodiment of the interior bottom surface 922 could include straight angled surfaces.

The interior vertical surface 920 is formed to fit the bungee ball 104 of FIG. 1 so that the ball 202 of FIG. 2 can slide down the interior vertical surface 920 into the interior bottom surface 922. The elastic cord 204 of FIG. 2 can be moved through a side opening 926 and down through a bottom opening 928.

The side opening 926 can taper from a top area to near a bottom area. Specifically, as the side opening 926 extends toward the bottom opening 928, the side opening 926 gets narrower.

The side opening 926 can begin with a larger width which can allow the elastic cord 204 to move freely therein and without friction induced by the rubbing between the side opening 926 and the elastic cord 204.

As the side opening 926 tapers, the width of the side opening 926 becomes small enough to create friction with the elastic cord 204 of the bungee ball 104 when it is pulled through the side opening 926. It is alternatively contemplated that the side opening 926 can have a constant width from the top area down to near the bottom area. The containers 906 can include an upper lip 930.

The upper lip 930 can be a rounded lip around the edge of the interior vertical surface 920. The side opening 926, which transitions from the upper lip 930 to the bottom opening 928 can also include an opening lip 932. The opening lip 932, similar to the upper lip 930, can be rounded. The upper lip 930 and the opening lip 932 can provide smooth operation of the cable storage system 900 by enabling a user to load the containers 906 quickly and without the additional wear on the elastic cord 204 that could accompany a non-rounded corner.

The rounded edge of the upper lip 930 and the opening lip 932 are depicted surrounding the bottom opening 928 as a bottom lip 934. The containers 906 can further include friction extensions 936.

The friction extensions 936 can be formed near the intersection of the opening lip 932 and the bottom lip 934. The friction extensions 936 can extend out into the side opening 926, narrowing the side opening 926 nearest to the bottom opening 928.

The friction extension 936 can increase the friction on the elastic cord 204 of the bungee ball 104 when the elastic cord 204 is slid through the side opening 926 and into the bottom opening 928. It is contemplated that the friction extension 936 can increase the friction to a point where a click can be produced when the elastic cord 204 of the bungee ball 104 is slid through the friction extension 936 and into the bottom opening 928.

Figure 10:
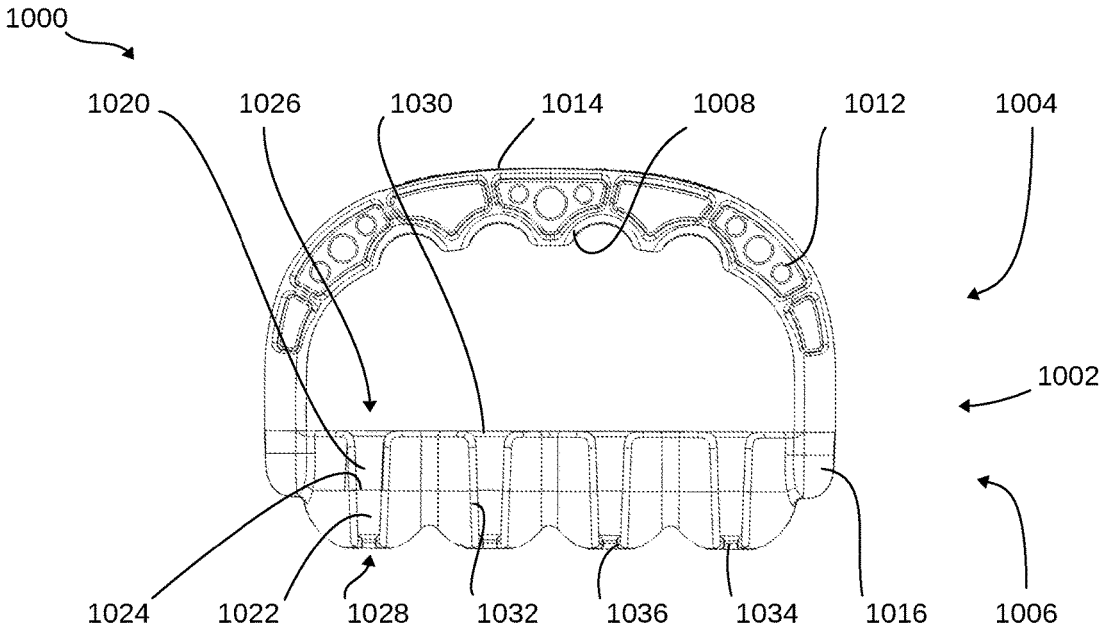
FIG. 10 is a front side view of the cable storage system in a third embodiment.

Referring now to FIG. 10, therein is shown a front side view of the cable storage system 1000 in a third embodiment. A storage rack 1002 of the cable storage system 1000 is shown having a handle 1004 in direct physical contact with containers 1006.

The handle 1004 is depicted spanning four containers 1006, which are positioned therebetween. It has been discovered that when using fewer containers 1006, the handle supports 310 of FIG. 3 can be eliminated while retaining adequate structural rigidity.

The handle 1004 can include a handle grip 1008 for providing an intuitive and secure hand placement for most hand sizes. In some embodiments, it has been discovered that the need for handle supports can be omitted from embodiments when the intended weight of cables 106 of FIG. 1 to be hung from the containers 1006 will not cause deformation of the handle 1004. The handle 1004 is shown skeletonized with material removal recesses 1012 formed therein.

It has been discovered that the material removal recesses 1012 can reduce the overall weight of the cable storage system 1000, which allows easier and more nuanced use of the cable storage system 1000 while simultaneously retaining a highly rigid structure. The handle 1004 can further include texturing 1014. The texturing 1014 can be a patterned texture, a company logo, or a combination thereof.

The handle 1004 can be coupled to the containers 1006 at mounting platforms 1016. The mounting platforms 1016 can be formed integral with the containers 1006 and can include a through hole. The handle 1004 can be screwed down onto the mounting platforms 1016 with screws extending through the mounting platforms 1016 and into female threaded recesses near the ends of the handle 1004.

The mounting platforms 1016 can be edge mounting platforms on either side of the cable storage system 1000. The mounting platforms 1016 can be formed together with and integral to the containers 1006 so that the containers 1006 should be understood to include the mounting platforms 1016. The containers 1006 themselves are shown to be evenly spaced between the mounting platforms 1016.

Each of the containers 1006 can include an interior vertical surface 1020 and an interior bottom surface 1022. The containers 1006 can transition from the interior vertical surface 1020 to the interior bottom surface 1022 at a bottom transition 1024.

The bottom transition 1024 can extend around the interior of the containers 1006 and can separate the interior vertical surface 1020 from the interior bottom surface 1022. The bottom transition 1024 can be the line within the containers 1006 when the interior surface changes from being straight and vertical as part of the interior vertical surface 1020 to a curved inward-sloping bottom surface of the interior bottom surface 1022.

As is shown, the interior bottom surface 1022 can approximate a hemisphere although other interior bottom surfaces 1022 are contemplated. For example, a flat interior bottom surface 1022 is contemplated. Further an interior bottom surface 1022 with a steeper or shallower curve from a hemisphere is contemplated. Yet further, an embodiment of the interior bottom surface 1022 could include straight angled surfaces.

The interior vertical surface 1020 is formed to fit the bungee ball 104 of FIG. 1 so that the ball 202 of FIG. 2 can slide down the interior vertical surface 1020 into the interior bottom surface 1022. The elastic cord 204 of FIG. 2 can be moved through a side opening 1026 and down through a bottom opening 1028.

The side opening 1026 can taper from a top area to near a bottom area. Specifically, as the side opening 1026 extends toward the bottom opening 1028, the side opening 1026 gets narrower.

The side opening 1026 can begin with a larger width which can allow the elastic cord 204 to move freely therein and without friction induced by the rubbing between the side opening 1026 and the elastic cord 204.

As the side opening 1026 tapers, the width of the side opening 1026 becomes small enough to create friction with the elastic cord 204 of the bungee ball 104 when it is pulled through the side opening 1026. It is alternatively contemplated that the side opening 1026 can have a constant width from the top area down to near the bottom area. The containers 1006 can include an upper lip 1030.

The upper lip 1030 can be a rounded lip around the edge of the interior vertical surface 1020. The side opening 1026, which transitions from the upper lip 1030 to the bottom opening 1028 can also include an opening lip 1032. The opening lip 1032, similar to the upper lip 1030, can be rounded. The upper lip 1030 and the opening lip 1032 can provide smooth operation of the cable storage system 1000 by enabling a user to load the containers 1006 quickly and without the additional wear on the elastic cord 204 that could accompany a non-rounded corner.

The rounded edge of the upper lip 1030 and the opening lip 1032 are depicted surrounding the bottom opening 1028 as a bottom lip 1034. The containers 1006 can further include friction extensions 1036.

The friction extensions 1036 can be formed near the intersection of the opening lip 1032 and the bottom lip 1034. The friction extensions 1036 can extend out into the side opening 1026, narrowing the side opening 1026 nearest to the bottom opening 1028.

The friction extension 1036 can increase the friction on the elastic cord 204 of the bungee ball 104 when the elastic cord 204 is slid through the side opening 1026 and into the bottom opening 1028. It is contemplated that the friction extension 1036 can increase the friction to a point where a click can be produced when the elastic cord 204 of the bungee ball 104 is slid through the friction extension 1036 and into the bottom opening 1028.

Figure 11:
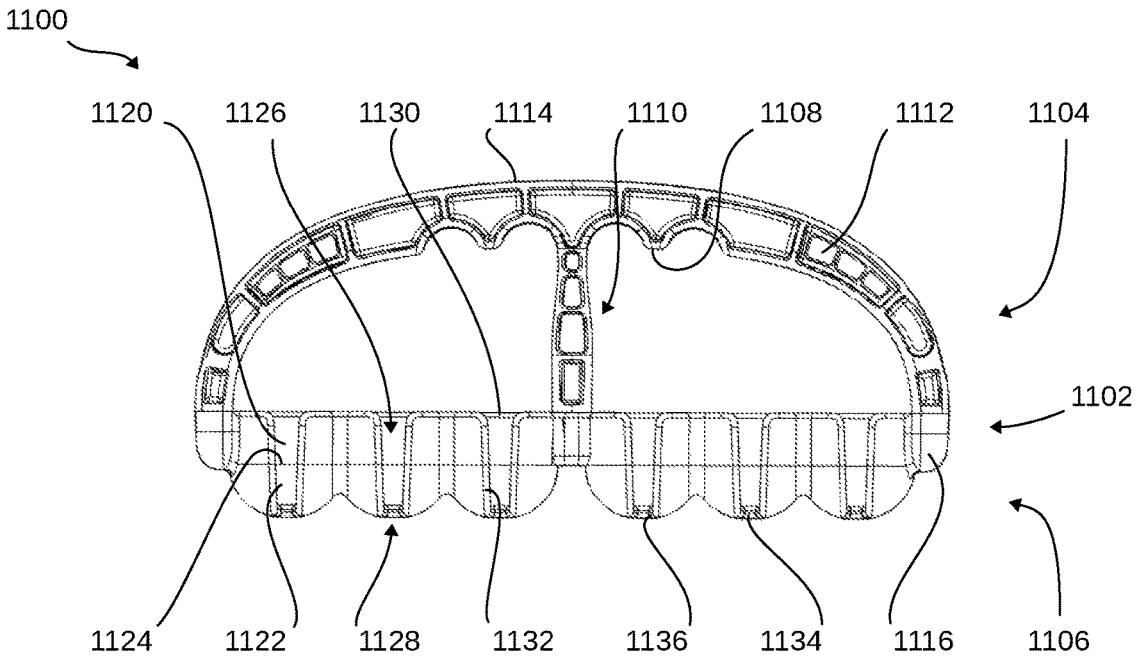
FIG. 11 is a front side view of the cable storage system in a fourth embodiment.

Referring now to FIG. 11, therein is shown a front side view of the cable storage system 1100 in a fourth embodiment. A storage rack 1102 of the cable storage system 1100 is shown having a handle 1104 in direct physical contact with containers 1106.

The handle 1104 can include a handle grip 1108 for providing an intuitive and secure hand placement for most hand sizes. In the middle of the handle grip 1108, the handle 1104 is shown having a handle support 1110.

The handle support 1110 can extend from the handle 1104 to the containers 1106 and form another attachment point between the handle 1104 and the containers 1106. It is contemplated that the handle support 1110 could be formed integrally with the handle 1104 and later attached to the containers 1106.

Alternatively, it is contemplated that the handle support 1110 could be affixed to both the handle 1104 as well as the containers 1106 after formation of the handle 1104. The handle 1104, along with the handle support 1110, are shown skeletonized with material removal recesses 1112 formed therein.

It has been discovered that the material removal recesses 1112 can reduce the overall weight of the cable storage system 1100, which allows easier and more nuanced use of the cable storage system 1100 while simultaneously retaining a highly rigid structure. The handle 1104 can further include texturing 1114. The texturing 1114 can be a patterned texture, a company logo, or a combination thereof.

The handle 1104 and the handle support 1110 can be coupled to the containers 1106 at mounting platforms 1116. The mounting platforms 1116 can be formed integral with the containers 1106 and can include a through hole. The handle 1104 can be screwed down onto the mounting platforms 1116 with screws extending through the mounting platforms 1116 and into female threaded recesses of the handle 1104.

The mounting platforms 1116 can be edge mounting platforms on either side of the cable storage system 1100. One of the mounting platforms 1116 is also depicted as centered between the containers 1106. The cable storage system 1100 is depicted having six of the containers 1106, with three of the containers 1106 on either side of the handle support 1110.

The mounting platforms 1116 can be formed together with and integral to the containers 1106 so that the containers 1106 should be understood to include the mounting platforms 1116. The containers 1106 themselves are shown to be evenly spaced between the mounting platforms 1116.

Each of the containers 1106 can include an interior vertical surface 1120 and an interior bottom surface 1122. The containers 1106 can transition from the interior vertical surface 1120 to the interior bottom surface 1122 at a bottom transition 1124.

The bottom transition 1124 can extend around the interior of the containers 1106 and can separate the interior vertical surface 1120 from the interior bottom surface 1122. The bottom transition 1124 can be the line within the containers 1106 when the interior surface changes from being straight and vertical as part of the interior vertical surface 1120 to a curved inward-sloping bottom surface of the interior bottom surface 1122.

As is shown, the interior bottom surface 1122 can approximate a hemisphere although other interior bottom surfaces 1122 are contemplated. For example, a flat interior bottom surface 1122 is contemplated. Further an interior bottom surface 1122 with a steeper or shallower curve from a hemisphere is contemplated. Yet further, an embodiment of the interior bottom surface 1122 could include straight angled surfaces.

The interior vertical surface 1120 is formed to fit the bungee ball 114 of FIG. 1 so that the ball 202 of FIG. 2 can slide down the interior vertical surface 1120 into the interior bottom surface 1122. The elastic cord 204 of FIG. 2 can be moved through a side opening 1126 and down through a bottom opening 1128.

The side opening 1126 can taper from a top area to near a bottom area. Specifically, as the side opening 1126 extends toward the bottom opening 1128, the side opening 1126 gets narrower.

The side opening 1126 can begin with a larger width which can allow the elastic cord 204 to move freely therein and without friction induced by the rubbing between the side opening 1126 and the elastic cord 204.

As the side opening 1126 tapers, the width of the side opening 1126 becomes small enough to create friction with the elastic cord 204 of the bungee ball 114 when it is pulled through the side opening 1126. It is alternatively contemplated that the side opening 1126 can have a constant width from the top area down to near the bottom area. The containers 1106 can include an upper lip 1130.

The upper lip 1130 can be a rounded lip around the edge of the interior vertical surface 1120. The side opening 1126, which transitions from the upper lip 1130 to the bottom opening 1128 can also include an opening lip 1132. The opening lip 1132, similar to the upper lip 1130, can be rounded. The upper lip 1130 and the opening lip 1132 can provide smooth operation of the cable storage system 1100 by enabling a user to load the containers 1106 quickly and without the additional wear on the elastic cord 204 that could accompany a non-rounded corner.

The rounded edge of the upper lip 1130 and the opening lip 1132 are depicted surrounding the bottom opening 1128 as a bottom lip 1134. The containers 1106 can further include friction extensions 1136.

The friction extensions 1136 can be formed near the intersection of the opening lip 1132 and the bottom lip 1134. The friction extension 1136 can extend out into the side opening 1126, narrowing the side opening 1126 nearest to the bottom opening 1128.

The friction extension 1136 can increase the friction on the elastic cord 204 of the bungee ball 114 when the elastic cord 204 is slid through the side opening 1126 and into the bottom opening 1128. It is contemplated that the friction extension 1136 can increase the friction to a point where a click can be produced when the elastic cord 204 of the bungee ball 114 is slid through the friction extension 1136 and into the bottom opening 1128.

Figure 12:
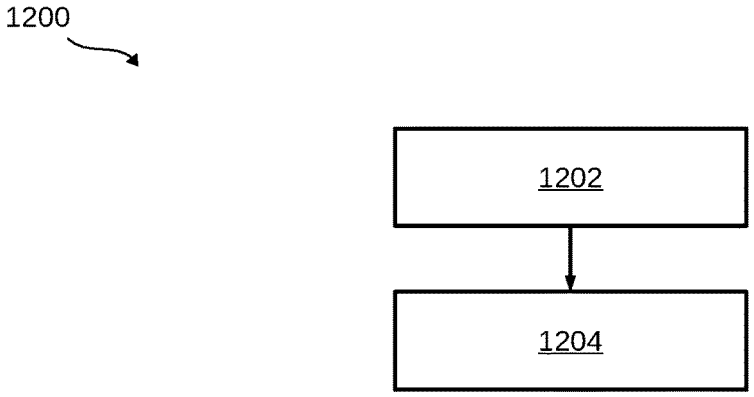
FIG. 12 is a flow chart for a method of manufacturing the cable storage system of FIG. 1.

Referring now to FIG. 12, therein is shown a flow chart 1200 for a method of manufacturing the cable storage system of FIG. 1. The method of manufacturing can include providing a bungee ball having a ball and an elastic cord, the elastic cord forming a loop and the elastic cord coupled to the ball at an attachment point, the loop configured to be fastened around a cable and secured around the ball in a block 1202; and forming a storage rack having a container affixed to a handle, the container having a side opening and a bottom opening, the side opening extending from a top area of the container to the bottom opening, the container configured to fit the ball therein, the side opening configured to allow the loop to be threaded therethrough and to extend out of the bottom opening in a block 1204.

Thus, it has been discovered that the cable storage system furnishes important and heretofore unknown and unavailable solutions, capabilities, and functional aspects. The resulting configurations are straightforward, cost-effective, uncomplicated, highly versatile, accurate, sensitive, and effective, and can be implemented by adapting known components for ready, efficient, and economical manufacturing, application, and utilization.

While the cable storage system has been described in conjunction with a specific best mode, it is to be understood that many alternatives, modifications, and variations will be apparent to those skilled in the art in light of the preceding description. Accordingly, it is intended to embrace all such alternatives, modifications, and variations, which fall within the scope of the included claims. All matters set forth herein or shown in the accompanying drawings are to be interpreted in an illustrative and non-limiting sense.

What is claimed is:

1. A cable storage system comprising:

a bungee ball having a generally spherical ball and an elastic cord extending downwardly from a bottom of the generally spherical ball, the elastic cord forming a loop and the elastic cord coupled to the ball at an attachment point, the loop configured to receive a wrapped cable; and a storage rack having a plurality of containers affixed to a handle, each container defining a generally semi-spherical shape, each container having a top, a bottom, a front, and a rear, wherein a cavity extends from the top of each container to the bottom of each container respectively; wherein a slot is formed in the front of each container, wherein an opening is formed in the bottom of each container, wherein the slots are continuous with the cavities and the openings for each container respectively, wherein the cavity of each container is configured to receive the generally spherical ball therein with a portion of the loop sliding within each slot down to the opening in each bottom respectively to allow the loop to be suspended underneath the containers respectively.

2. The system of claim 1, wherein a friction extension extends into a lower portion of each slot to narrow each slot near the opening in each bottom of the containers.

3. The system of claim 1, wherein the containers comprises a first container and a second container, wherein the storage rack further includes a support coupled between the first container and the second container, the support extending from the handle to the first container.

4. The system of claim 1, wherein the storage rack further includes a mounting platform beside the containers for coupling the containers to the handle.

5. A method of using a cable storage system comprising the steps of:

providing a bungee ball having a generally spherical ball and an elastic cord extending downwardly from a bottom of the generally spherical ball, the elastic cord forming a loop and the elastic cord coupled to the ball at an attachment point;

storing a cable on the loop; and providing a storage rack having a plurality of containers affixed to a handle, the containers defining a generally semi-spherical shape, the containers having a top, a bottom, a front, and a rear, wherein a cavity extends from the top of each container to the bottom of each container; wherein a slot is formed in the front of each container, wherein an opening is formed in the bottom of each container, wherein each slot is continuous with the cavity and the opening of each container respectively;

inserting the generally spherical ball within the cavity of a first container from said containers with a portion of the loop sliding within the slot of the first container down to the opening in the bottom of the first container to allow the loop to be suspended underneath the first container.

6. The method of claim 5, further comprising the step of providing a friction extension that extends into a lower portion of each slot to narrow each slot near the opening in the bottom of each container respectively.

7. The method of claim 5, further comprising the step of providing a support, the support extending from the handle to the containers.

8. The method of claim 5, further comprising the step of providing a mounting platform beside the containers for coupling the containers to the handle.

9. The method of claim 5, providing a mounting platform coupled to the containers and a support which is coupled to the handle.

10. The method of claim 5, further comprising the step of providing recesses within the handle.

11. The method of claim 5, further comprising the step of providing finger grooves within the handle.

* * * * *